US008931131B1

(12) United States Patent
Feduke

(10) Patent No.: US 8,931,131 B1
(45) Date of Patent: Jan. 13, 2015

(54) POWER SNAKE APPARATUS

(76) Inventor: Daniel Feduke, Johnson City, NY (US)

( * ) Notice: Subject to any disclaimer, the term of this patent is extended or adjusted under 35 U.S.C. 154(b) by 40 days.

(21) Appl. No.: 12/781,006

(22) Filed: May 17, 2010

(51) Int. Cl.
*B08B 9/02* (2006.01)
*B08B 1/00* (2006.01)

(52) U.S. Cl.
USPC ..... 15/104.33; 134/6

(58) Field of Classification Search
USPC ..... 15/104.31, 104.33; 134/6
See application file for complete search history.

(56) References Cited

U.S. PATENT DOCUMENTS 4,793,017 A * 12/1988 Kaye ..... 15/104.33
5,226,207 A 7/1993 Elzaurdia
5,875,508 A * 3/1999 Hale ..... 15/104.31
5,965,998 A * 10/1999 Whiting et al. ..... 320/165
6,615,436 B1 9/2003 Burch, Jr. et al.
7,676,879 B1 3/2010 Rutenberg et al.
8,615,837 B2 * 12/2013 Hale et al. ..... 15/104.33
2007/0297778 A1 * 12/2007 Lange ..... 396/19
2008/0083058 A1 4/2008 Heffner
2008/0098544 A1 * 5/2008 Rutkowski et al. ..... 15/104.33

* cited by examiner

*Primary Examiner* — Laura C Guidotti
(74) *Attorney, Agent, or Firm* — James Ray & Assoc.

(57) ABSTRACT

A power snake apparatus including a motor connected to a rotatable drum that contains a coiled cable for drain cleaning operations. The power snake also includes a battery for powering the motor, the battery preferably being of the type normally installed on motorcycles and being rechargeable from a standard motor vehicle electrical recharging system. The apparatus may also include an AC/DC transformer for powering the motor or recharging the motorcycle battery from a standard electrical outlet. The components of the power snake apparatus are mounted on a frame, which may also include a removable handle and a plurality of wheels to facilitate mobility of the device.

15 Claims, 1 Drawing Sheet

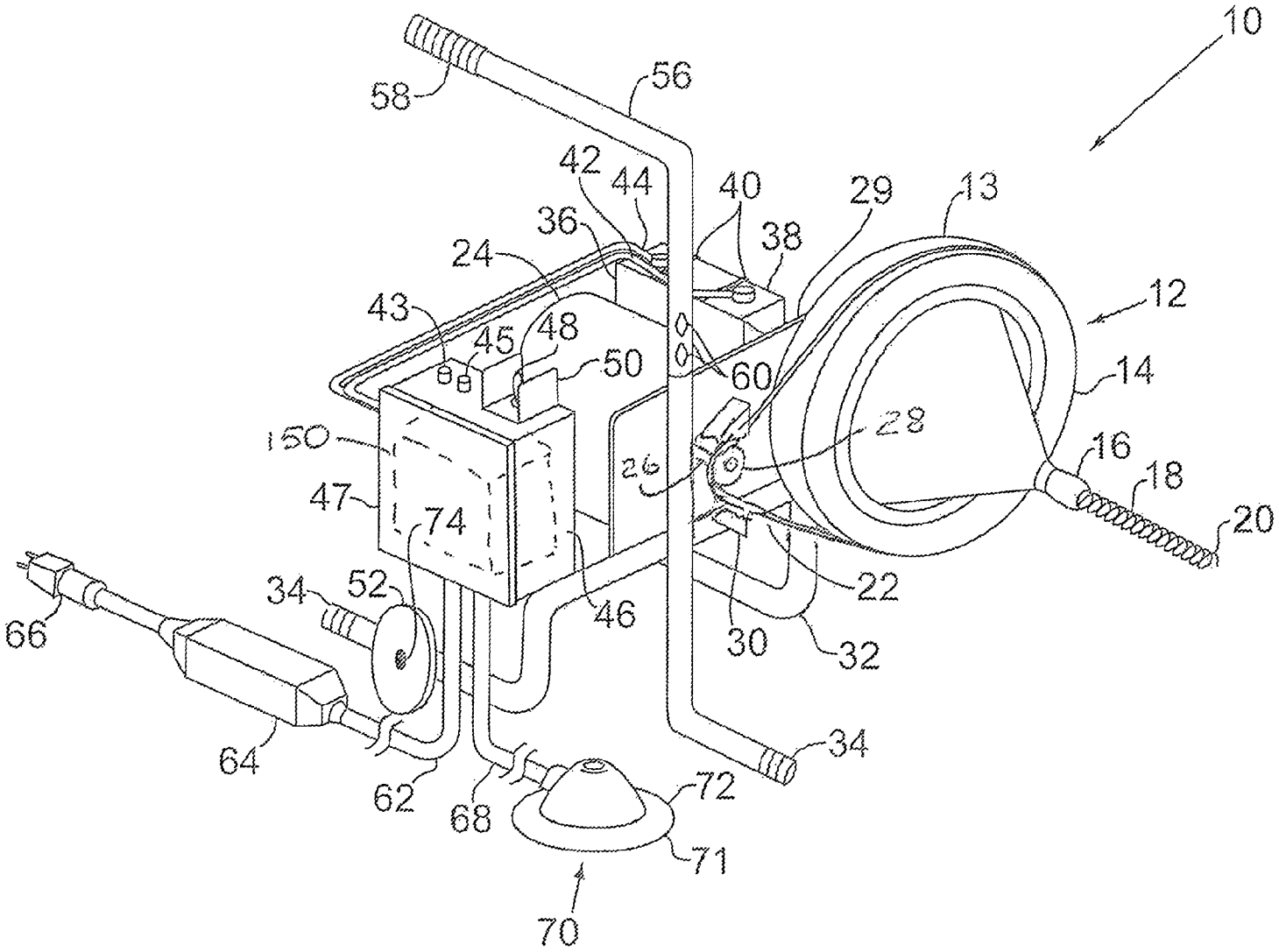
10
12
13
14
16
18
20
22
24
26
28
29
30
32
34
36
38
40
42
43
44
45
46
47
48
50
52
56
58
60
62
64
66
68
70
71
72
74
150

POWER SNAKE APPARATUS

FIELD OF THE INVENTION

The present invention relates to a plumbing device and, more particularly, to a motorized drain cleaner that may be powered from either a self-contained battery or a standard alternating current (AC) electrical outlet, such battery desirably being of the type typically installed on motorcycles and rechargeable from either power source.

BACKGROUND OF THE INVENTION

Drain cleaning devices have been provided to remove or push through obstructions that become lodged in piping circuits. These devices, which are well known in the art, typically comprise a drain cleaning cable (or snake) coiled within a rotatable drum. In operation, the snake is inserted into the piping circuit, and then the drum is rotated as the snake is extended forward to maneuver through pipe fittings and clear the obstruction. The end of the snake typically includes a cutter or auger tip to engage the obstruction, which may then be pushed through the pipe circuit or pulled out of it as the snake is retracted. Heavy-duty devices are typically mounted on a frame which may be positioned near an access point to the drain that requires obstruction removal.

Light-duty drain cleaners, such as those employed for removing hair from drain pipes, are commonly hand-operated. Some obstructions are more difficult to remove and require a motor-operated device for enhanced power and increased speed of rotation. U.S. Pat. No. 6,615,436 discloses a drain cleaning device operated with a removable hand crank that may be replaced by a drill motor. The unit is held in position by one hand in contact with a pistol grip, which in turn is attached to the rotatable drum. Another type of cleaning device is disclosed in U.S. Pat. Pub. No. 2008/0083058. A telescoping plumbing device of limited rotational capabilities is extended and retracted telescopically to abruptly and forcibly remove an obstruction in the pipe.

U.S. Pat. No. 5,226,207 discloses a cleaning device that contains a small, insertable motor located near the leading end of the snake. Most of the length of the snake does not rotate. The tip at the leading end of the snake is attached to the motor and therefore rotates to remove the target obstruction.

Spartan Tool Co. of Mendota, Ill., offers a power snake device under the product designation, "Model 81." This device includes an alternating current motor, which is attached to a standard electrical wall outlet with a supplied power cord. Because it operates exclusively on AC power, an outlet must be located nearby to operate the device. Rigid Tool Co. of Elyria, Ohio, offers a similar motorized snake, model "K-40" operable from standard AC wall outlet. Rigid Tool Co. also offers a cordless, battery-operated power snake device, model "K-40B," which further includes a battery charger that may be plugged into a wall outlet.

The hand-held devices presently available on the market have the advantages of being lightweight, highly portable, and relatively inexpensive. They are, therefore, ideal for light-duty drain cleaning operations such as those encountered in a residential home. Hand-held drain cleaners, however, are often not robust or powerful enough to remove difficult obstructions. Moreover, a device sufficiently designed for heavy-duty obstruction removal would be too unwieldy for an operator to hold while in use.

All of the known frame-mounted power snakes available require access to a standard AC wall outlet for use. In particular, the units with direct AC driven motors must be attached to a wall outlet with a power cord when the motor is in operation. At certain job sites, it may be problematic to find a suitable AC power outlet that is live, accessible, and located in sufficient proximity to supply power to the drain cleaner. Moreover, the need to access remote outlets introduces safety concerns, namely excessive use of electrical extension cords. These cords may need to run through areas that are wet or otherwise unsafe or inconvenient for the power snake operator. This problem is alleviated, to some extent, with the available battery operated drain cleaners. Access to a standard AC wall outlet is still required, however, to recharge the unit's batteries. This power source is not always conveniently accessible or even available at remote job sites. Moreover, even if the power source is available, the power snake will not operate if the battery loses its charge from, e.g. extended use or forgetting to plug the charger into the wall outlet. No backup power source, such as AC power from a wall outlet, may be used in this circumstance.

An additional shortcoming of the known power snake devices concerns the relative portability of the units. These units are mounted on frames which must be carried to the required location for use. Heavy-duty, powerful units tend to be heavy and cumbersome to handle, thereby leading to operator fatigue when carrying the snake to remote locations required for access to clogged drains. Furthermore, it may be necessary to carry these units in an awkward posture, thereby straining the user and leading to potential back injuries and the like.

What is needed is a powered drain cleaning device operable from a self-contained battery. Such battery would desirably be of the type normally employed for use on motorcycles, which would provide the power necessary to effectively operate the snake motor for heavy-duty obstruction removal while being sufficiently compact and lightweight to facilitate portability of the power snake. To avoid the need to obtain access to a standard AC wall outlet, the battery could be capable of recharge through an automotive recharging (alternator) circuit. In addition, the components could be mounted on a common frame with wheels attached, allowing the operator to roll the snake over substantially flat surfaces to facilitate ease of use and enhance user safety. An additional benefit would be realized if the device could optionally be connected to a standard AC wall outlet to run the motor directly from AC power in the event that the battery loses its charge, or to use AC power to recharge the battery in the event that motor vehicle charging is inconvenient or unavailable at the time.

SUMMARY OF THE INVENTION

It is an object of the present invention to provide a power snake drain cleaning device having a rotatable snake cable with a suitable auger or cutter tip to remove obstructions from piping circuits. Such power snake may be equipped with a motor powered either from a supplied battery or via a suitable power transformer from an AC wall outlet. Powering the motor from the supplied battery offers a high degree of portability of the power snake, and negates the need to access a nearby wall outlet. Batteries of the type normally employed for motorcycle use can supply sufficient power to the snake motor to effectively remove heavy-duty obstructions from piping circuits, while limiting size and weight to enhance the portability of the unit. In addition, optional powering of the motor from a wall outlet is useful to the operator when an accessible wall outlet is located nearby and the battery may not have sufficient charge to complete the desired task. Including dual power capabilities allows the operator to select the most appropriate or convenient method of operation for any given task or job site location.

It is another object of the invention to provide a battery rechargeable by a motor vehicle electrical recharging system. Work vehicles are typically used by contractors to haul power snake devices to various job site locations. A work vehicle can be equipped with a wiring harness to position a secondary positive and/or negative terminal near the location where the power snake is stored within the vehicle. (A less desirable, but still viable alternative is to connect the battery to the vehicle electrical system with automotive jumper cables.) Additionally, the power snake may be equipped with secondary battery terminals. It is thereby convenient for the operator to connect the secondary battery terminals to the motor vehicle terminals for battery recharging while the power snake is located within the vehicle for transportation. Therefore, an object of the invention is to supply a battery that may be directly recharged from the motor vehicle recharging system. A standard 12V motorcycle battery is compatible with the recharging system of a standard 12V motor vehicle electrical system. Moreover, this charging scheme is effective and efficient. The battery will typically retain a charge at all times with minimal additional effort required by the operator. As the operator travels to various job site locations, the battery will be automatically recharged as necessary.

Another object of the invention is to include a power transformer that allows the snake motor to be powered from a standard AC wall outlet. A standard American 110 VAC wall outlet connection could be utilized, although it can be appreciated by a person skilled in the art that any standard AC power source and outlet connection can be utilized with the power snake, given the appropriate transforming capabilities, such as an American 220 VAC outlet or a variety of foreign AC power outlets. The supplied motorcycle battery can optionally be recharged from a wall outlet. This functionality may be useful in the event that the recharging vehicle is not available or not being used for transportation. In the latter case, it may be more efficient to recharge from a wall outlet than to run the vehicle engine solely to recharge the power snake battery.

Another object of the present invention is to mount all of the components of the power snake on a common frame, preferably with a plurality of wheels attached to enhance the portability of the device. While some degree of lifting may be required to position the snake in an appropriate location for use or lift it into a vehicle for transportation and recharging, the amount of lifting and carrying will be greatly reduced. The power snake may be rolled along the wheels instead of carried to remote locations, thereby easing the operator's workload and reducing the likelihood of personal injury. Yet another object of the invention is to attach a handle to the frame to improve the ergonomics of the snake for lifting, carrying, or rolling along the wheels. This handle may be made easily removable to make the unit more compact for storage.

BRIEF DESCRIPTION OF THE DRAWINGS

These and other features and advantages of this invention will be more readily understood from the following detailed description of the various aspects of the invention taken in conjunction with the accompanying drawings in which:

FIG. 1 is a perspective view of the power snake apparatus with the removable handle attached.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements among the drawings. In other words, for the sake of clarity and brevity, like elements and components of each embodiment bear the same designations throughout the description.

DETAILED DESCRIPTION OF THE INVENTION

FIG. 1 shows a power snake apparatus 10 having a rotatable drum 12, which encloses and contains a portion of drain cleaning cable 18. Drum 12 has a front face 14 attached to drum body 13. Annulus 16 is part of front face 14 for receiving cable 18 within drum body 13. Auger or cutter tip 20 is installed on the end of cable 18 for engaging an obstruction in a piping circuit. Drum 12 is rotatably attached to support plate 29, which in turn is securely attached to frame 32.

Frame 32 is shaped to form four elongated support members. A rubber mounting tip 34 is installed on the four terminal ends of the frame members. Two wheels 52 are rotatably attached to the two lower rearwardly facing members of frame 32. Wheel axle 74 is attached on either end to each of the two wheels 52. The three rearwardly facing frame members are designed to allow power snake 10 to securely rest on a flat surface when rotated by 90° counterclockwise, as viewed from the right-hand-side. Removable hand 56, having a hand grip 58, is attached to frame 32 with wing nuts 60 so that it may be easily removed and reinstalled.

Drum rotation is powered by motor 24, The front face of motor 24 is attached to support plate 29. Rotor 26 extends frontwardly through an opening in support plate 29 and is attached to pulley wheel 28. Pulley belt 22 wraps around pulley wheel 28 on one end and drum body 13 on an opposite end to drive rotation of drum 12. Pulley guard 30 extends frontwardly off of support plate 29 to enclose pulley wheel 28, thereby preventing inadvertent contact with moving parts.

Motorcycle battery 38, such as Model No. DCM0018 manufactured by Interstate Batteries Company, is retained within battery case 36 and held securely in place with securing straps 40. Battery terminal cables 42 and 44 are mounted on terminals of battery 38 on one end, and terminate inside of electrical case 46 on the opposite end. Remote battery terminals 43 and 45 are provided to facilitate battery recharging through an automobile recharging system. Power cord 62 terminates at transformer/battery recharging module 150 inside of electrical case 46 on one end and with power plug 66 on the opposite end. GFCI module 64 is located along power cord 62 to protect against ground faults.

Electrical case 46 is enclosed by front face 47. Toggle switch 48 is a multi-position switch having "forward," "reverse," and "off" positions. Switch 48 is protected by switch guard 50.

Foot pedal 70 is attached to air switch 160 (located with electrical case 46) via air hose 68. Foot pedal 70 comprises a base 71 and air bladder 72. Foot pedal 70 is activated by applying pressure to air bladder 72, the pressure change in air hose 68 causing air switch 160 to engage (switch from the "off" position to the "on" position).

To operate the power snake 10, the unit is placed in the vicinity of a drain with a clog that requires removal. Drain cleaning cable 18 is pulled from drum 12 through annulus 16 and fed into the drain. Switch 48 is placed in the "forward" position, and foot pedal 70 is activated to engage motor 24. Motor 24 turns pulley wheel 28 and drum 12 via pulley cable 22. Rotation of drum 12 induces an equivalent rotation in drain cleaning cable 18 and cutter/auger tip 20. The rotation assists cable 18 to maneuver through the piping circuit, passing through fittings as necessary, and engage the target obstruction. The snake operator continues to feed cable 18 into the drain as necessary until the obstruction is reached. At that point, the rotation of cable 18 cuts through or dislodges the obstruction.

In some cases, cable 18 may become "hung up" on an obstruction within the piping circuit. In that situation, the operator can release pressure on foot pedal 70 to deactivate motor 24, flip toggle switch 48 to the "reverse" position, and reengage foot pedal 70 to induce reverse rotation of cable 18. After cable 18 has pulled back from the obstruction, the operator can make repeated attempts, as necessary, in the "forward" position to remove the target obstruction. Once the obstruction has been substantially removed, the operator may retract cable 18 by operating the power snake in the "reverse" position and feeding cable 18 back into drum 12 via annulus 16.

Normally, power snake 10 is powered from motorcycle battery 38. In the event that battery 38 has lost its charge, power may be supplied by inserting power plug 66 into a standard AC wall outlet. This will also activate the battery recharging module to restore a charge to battery 38. Battery 38 may also be recharged by electrically connecting the battery terminals or remote terminals 43 and 45 to an automobile electrical recharging system. Thus, battery 38 will be recharged as the operator commutes between job site locations.

Since other modifications and changes will be apparent to those skilled in the art, the invention is not considered limited to the description above for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A drain cleaning device comprising:

a frame;

a support plate attached to said frame and extending in a vertical plane during use of said drain cleaning device;

a rotatable cable drum rotateably attached to said support plate adjacent one surface thereof and having a drum axis, front wall, and back wall, said drum having an annulus on said front wall coaxial with said drum axis for receiving a drain cleaning cable;

a drain cleaning cable coiled in said drum for rotation therewith and having a distal end for extending from said drum into a drain to be cleaned;

a motor attached to an opposite surface of said support plate rearward of said cable drum and having a rotor for driving rotation of said drum about said drum axis, said rotor having a rotor axis thereof being offset from said drum axis;

a pulley wheel attached to said rotor adjacent said one surface of said support plate and a continuous belt interconnecting said pulley wheel and said back wall;

a 12V rechargeable battery positioned on said frame and operatively connected to said motor for providing power thereto, said battery being rechargeable through an automotive electrical recharging system;

an electrical case positioned on said frame and including a recharging module and electrical connections with said rechargeable battery and a source of electric energy; and an electrical switch provided on said electrical case and interconnecting said rechargeable battery and said motor for activating and deactivating said motor.

2. The drain cleaning device of claim 1, further comprising a battery case supported by said frame, said battery being securely held within said case.

3. The drain cleaning device of claim 2, further comprising a plurality of wheels rotatably attached to said frame.

4. The drain cleaning device of claim 3, further comprising a handle removably attached to said frame and positioned to facilitate rolling of said frame along said wheels.

5. The drain cleaning device of claim 2, wherein said electrical switch comprises a foot pedal switch.

6. A drain cleaning device comprising:

a frame;

a support plate attached to said frame and extending in a vertical plane during use of said drain cleaning device;

a rotatable cable drum having a drum axis, front wall, and back wall, said drum having an annulus on said front wall coaxial with said drum axis for receiving a drain cleaning cable;

a drain cleaning cable coiled in said drum for rotation therewith and having a distal end for extending from said drum into a drain to be cleaned;

a low-voltage motor attached to an opposite surface of said support plate rearward of said cable drub and having a rotor for driving rotation of said drum about said drum axis, said rotor having a rotor axis thereof being offset from said drum axis;

a pulley wheel attached to said rotor and a continuous belt interconnecting said pulley wheel and said back wall;

a low-voltage, rechargeable battery for powering said motor;

an electrical switch interconnecting said low-voltage, rechargeable battery and said low-voltage motor for activating and deactivating said motor; and an AC-to-DC transformer having an alternating current electrical plug for connecting said transformer to an electrical wall outlet and electrical translation means for connecting a direct current power output of said transformer to said electrical switch.

7. The drain cleaning device of claim 6, wherein said rechargeable battery is a 12V battery.

8. The drain cleaning device of claim 6, further comprising a battery case supported by said frame, said rechargeable battery being securely held within said case.

9. The drain cleaning device of claim 6, further comprising a plurality of wheels rotatably attached to said frame.

10. The drain cleaning device of claim 9, further comprising a handle removably attached to said frame and positioned to facilitate rolling of said frame along said wheels.

11. The drain cleaning device of claim 6, wherein said electrical switch comprises a foot pedal switch.

12. The drain cleaning device of claim 6, further comprising a battery charger electrically connected to said rechargeable battery for recharging said battery from an electrical wall outlet, said battery charger supported by said frame.

13. A method of recharging a battery of an electrically powered drain cleaning device comprising:

a rotatable cable drum attached to a support plate adjacent one surface thereof and having a drum axis, front wall, and back wall, said drum having an annulus on said front wall coaxial with said drum axis for receiving a drain cleaning cable;

a drain cleaning cable coiled in said drum for rotation therewith and having a distal end for extending from said drum into a drain to be cleaned;

a motor attached to an opposite surface of said support plate rearward of said cable drum and having a rotor for driving rotation of said drum about said drum axis, said rotor having a rotor axis thereof being offset from said drum axis;

a pulley wheel attached to said rotor adjacent said one surface and a continuous belt interconnecting said pulley wheel and said back wall;

a battery for powering said motor;

an electrical switch interconnecting said battery and said motor for activating and deactivating said motor;

an AC-to-DC transformer having an alternating current electrical plug for connecting said transformer to an electrical wall outlet and electrical translation means for connecting a direct current power output of said transformer to said electrical switch; and a frame supporting said drum, motor, battery, switch, transformer, support plate and pulley wheel, the steps comprising:

electrically connecting said battery to said AC-to-DC transformer;

electrically connecting said AC-to-DC transformer to an electrical recharging system of a motor vehicle having an engine; and operating said engine to engage said recharging system until said battery has been recharged.

14. The method of claim 13, wherein said battery is a motorcycle battery.

15. The method of claim 14, wherein said battery is electrically connected to said recharging system via a wiring harness attached to said automobile.

* * * * *